US012343585B2

(12) United States Patent
Liu

(10) Patent No.: US 12,343,585 B2
(45) Date of Patent: Jul. 1, 2025

(54) ADJUSTABLE DUMBBELL

(71) Applicant: OHFG TECHNOLOGIES(SHANGHAI) CO.,LTD, Shanghai (CN)

(72) Inventor: Ping Liu, Shanghai (CN)

(73) Assignee: OHFG TECHNOLOGIES(SHANGHAI) CO., LTD, Shanghai (CN)

( * ) Notice: Subject to any disclaimer, the term of this patent is extended or adjusted under 35 U.S.C. 154(b) by 182 days.

(21) Appl. No.: 18/334,649

(22) Filed: Jun. 14, 2023

(65) Prior Publication Data

US 2024/0408434 A1 Dec. 12, 2024

(30) Foreign Application Priority Data

Jun. 6, 2023 (CN) ..... 202310662407.X

(51) Int. Cl.
*A63B 21/072* (2006.01)

(52) U.S. Cl.
CPC ..... *A63B 21/0726* (2013.01); *A63B 21/0728* (2013.01); *A63B 2225/09* (2013.01)

(58) Field of Classification Search
CPC ..... A63B 21/0726; A63B 21/0728; A63B 2225/09; A63B 21/075; A63B 71/0036; A63B 21/0724; A63B 21/072
See application file for complete search history.

(56) References Cited

U.S. PATENT DOCUMENTS

| | | | | |
|---|---|---|---|---|
| 7,775,947 | B2 * | 8/2010 | Towley, III | A63B 21/075 482/106 |
| 11,219,795 | B1 * | 1/2022 | Yao | A63B 71/0619 |
| 11,504,567 | B1 | 11/2022 | Hong | |
| 2008/0032873 | A1 * | 2/2008 | Towley | A63B 21/075 482/106 |
| 2012/0309597 | A1 | 12/2012 | Liu | |
| 2021/0187341 | A1 * | 6/2021 | Chen | A63B 21/0724 |
| 2022/0257993 | A1 | 8/2022 | Geng | |

* cited by examiner

*Primary Examiner* — Sundhara M Ganesan

(57) ABSTRACT

The application provides an adjustable dumbbell, including a dumbbell bar assembly and a plurality of dumbbell plates hooked to two sides of the dumbbell bar assembly. Inserting plate assemblies for being inserted into insertion ports of the dumbbell plates are disposed at two ends of the dumbbell bar assembly. The inserting plate assemblies are provided with damping block mounting holes, and the damping block mounting holes form third open slots at the bottoms of the inserting plate assemblies. Damping blocks are installed in the damping block mounting holes. The bottoms of the damping blocks abut against the bottoms of the insertion ports of the dumbbell plates through the third open slots.

10 Claims, 14 Drawing Sheets

A

ADJUSTABLE DUMBBELL

TECHNICAL FIELD

The application relates to the field of fitness equipment, in particular to an adjustable dumbbell.

BACKGROUND

Dumbbells are widely used as fitness equipment, and particularly, weight-adjustable dumbbells are favored by many fitness enthusiasts. A user needs to frequently adjust different weights or different numbers of dumbbell plates to realize various weight adjustments. But when the user uses an adjustable dumbbell, the user needs to frequently adjust different weights to meet the requirements of exercises. There are gaps between the dumbbell plates and a dumbbell bar assembly. During exercise time, because of inertia, the dumbbell plates and the dumbbell bar assembly move up and down relatively, the dumbbell plates also move left and right when the user does arm lift exercises, so the user feels insecure. Further, the user has to suffer from the impact of movement of the dumbbell plates and always worries about the falling risk of the dumbbell plates. The concentration of exercise is affected.

SUMMARY

The application aims to provide an adjustable dumbbell to realize no moving and reduce disturbance of movement of dumbbell plates to users when dumbbell plates are connected to a dumbbell bar assembly.

To achieve this goal, the application provides the following technical solution:

an adjustable dumbbell includes a dumbbell bar assembly and a plurality of dumbbell plates hooked to two sides of the dumbbell bar assembly. Inserting plate assemblies for being inserted into insertion ports of the dumbbell plates and limiting the dumbbell plates to rotate are disposed at two ends of the dumbbell bar assembly. The inserting plate assemblies are provided with damping block mounting holes, and the damping block mounting holes form first open slots at bottoms of the inserting plate assemblies. Damping blocks are installed in the damping block mounting holes. Bottoms of the damping blocks penetrate through the first open slots to abut against bottoms of the insertion ports of the dumbbell plates. The damping blocks can offset relative displacement of the dumbbell plates and the inserting plate assemblies through elastic deformation to reduce movement of the dumbbell plates and resonance between the dumbbell plates and the inserting plate assemblies in the using process, and consequently, user experience can be improved.

Further, the dumbbell bar assembly includes a bearing bar set. A casing is sleeved outside the bearing bar set. An outer wall of the bearing bar set is provided with protruding strips. The protruding strips abut against an inner wall of the casing. On the premise of not impeding sliding of the bearing bar set in the casing, movement of the bearing bar set inside the casing is reduced.

Further, the bearing bar set includes a left rack bearing bar and a right rack bearing bar which are identical in shape and size, and a spur gear shaft. The spur gear shaft is hinged to the interior of the casing. The left rack bearing bar and the right rack bearing bar are meshed with the spur gear shaft for transmission in the casing. A left rack part and a right rack part are respectively arranged on opposite sides of the left rack bearing bar and the right rack bearing bar, and a left bearing part and a right bearing part are respectively arranged on back sides of the left rack bearing bar and the right rack bearing bar. A plurality of protruding strips are arranged and respectively located on surfaces of the left bearing part and the right bearing part.

Further, the left rack part and the right rack part are respectively provided with sliding grooves. The right rack bearing bar is provided with a sliding block corresponding to the sliding groove of the left rack bearing bar. Similarly, the left rack bearing bar is provided with a sliding block corresponding to the sliding groove of the right rack bearing bar. The corresponding sliding blocks slide in the corresponding sliding grooves respectively. It can be ensured that the two rack bearing bars are adjusted smoothly and movements of the bearing bars is reduced.

Further, the inserting plate assemblies include hollow inserting plates, the hollow inserting plates are used to be inserted into the insertion ports of the dumbbell plates, the insertion ports are arranged in a V shape, and correspondingly, cross-sections of the hollow inserting plates are arranged in a V shape matched with the insertion ports in shape and size so that the hollow inserting plates are more closely matched with inner walls of the insertion ports of the dumbbell plates when the hollow inserting plates are inserted into the insertion ports, and gaps between the hollow inserting plates and the insertion ports are reduced. The hollow inserting plates are closely matched with the dumbbell plates to reduce the phenomena of the dumbbell plates moving left and right on the inserting plate assemblies.

Further, tops of the inserting plate assemblies are provided with second open slots communicating with internal parts thereof. The bearing bar set is provided with an adjusting handle. The adjusting handle penetrates through the corresponding second open slot to be fixedly connected with the bearing bar set. Positioning racks are arranged at the second open slots. Each of the positioning racks is provided with a plurality of positioning teeth. Correspondingly, a bottom end of the adjusting handle is provided with a positioning part matched with the positioning racks. When the positioning part is located at tooth roots of the positioning teeth, the adjusting handle is locked.

Further, the adjusting handle includes a hollow adjusting handle housing and a bolt. A nut part of the bolt is installed inside the adjusting handle housing in a limited manner, a screw of the bolt partially penetrates out of a bottom of the adjusting handle housing to be in threaded connection with the bearing bar set. A spring is sleeved on the bolt. One end of the spring abuts against a bottom end of the nut part of the bolt, and the other end of the spring abuts against a bottom side of an inner wall of the adjusting handle housing. Thus, the adjusting handle can automatically fall into a corresponding adjusting position under the action of restoring force of the spring when lifted upwards, thereby preventing the dumbbell plates from falling due to the fact that the adjusting handle gets stuck between two adjusting positions.

Further, the left rack bearing bar, the right rack bearing bar and the spur gear shaft are meshed and installed inside the casing. A tube wall of the casing is respectively provided with communicating ports corresponding to the left bearing part of the left rack bearing bar and the right bearing part of the right rack bearing bar so that the left bearing part and the right bearing part are hooked to the dumbbell plates through the communicating ports.

Further, the dumbbell bar assembly comprises a hollow tube, the hollow tube is sleeved outside the casing, and a rubber grip tube is sleeved on an outer side of the hollow tube. The hollow tube is disposed between the grip tube and the casing to facilitate force control at the grip tube.

Further, grip counterweights are fixedly connected to ends of the two inserting plate assemblies respectively to increase the weight of the dumbbell bar assembly without the dumbbell plates hooked and increase forms of exercise without the dumbbell plates hooked.

Based on the analysis, the application discloses an adjustable dumbbell. Protruding strips are disposed inside a dumbbell bar assembly to reduce movement between a bearing bar set and a casing. In addition, inserting plate assemblies are arranged in the same V-shaped structure as that of insertion ports of dumbbell plates to reduce movement between the inserting plate assemblies and the dumbbell plates. Damping blocks are installed in the inserting plate assemblies and abut against bottoms of the insertion ports of the dumbbell plates so that movement of the dumbbell plates and resonance between the dumbbell plates and the inserting plate assemblies are reduced in the using process, thereby reducing fear of the user in the using process and helping the user to focus on the training process.

BRIEF DESCRIPTION OF THE DRAWINGS

Drawings constituting a portion of the application are used for providing a further understanding of the application. Schematic embodiments of the application and descriptions thereof are intended to explain the application and are not construed to unduly limit this application. In the drawings.

Figure 1:
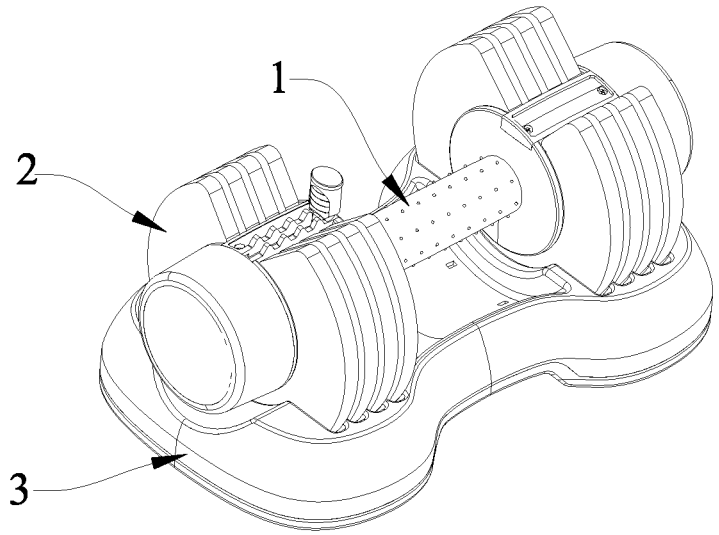
FIG. 1 is a structural schematic diagram of an adjustable dumbbell according to an embodiment of the application.
Figure 2:
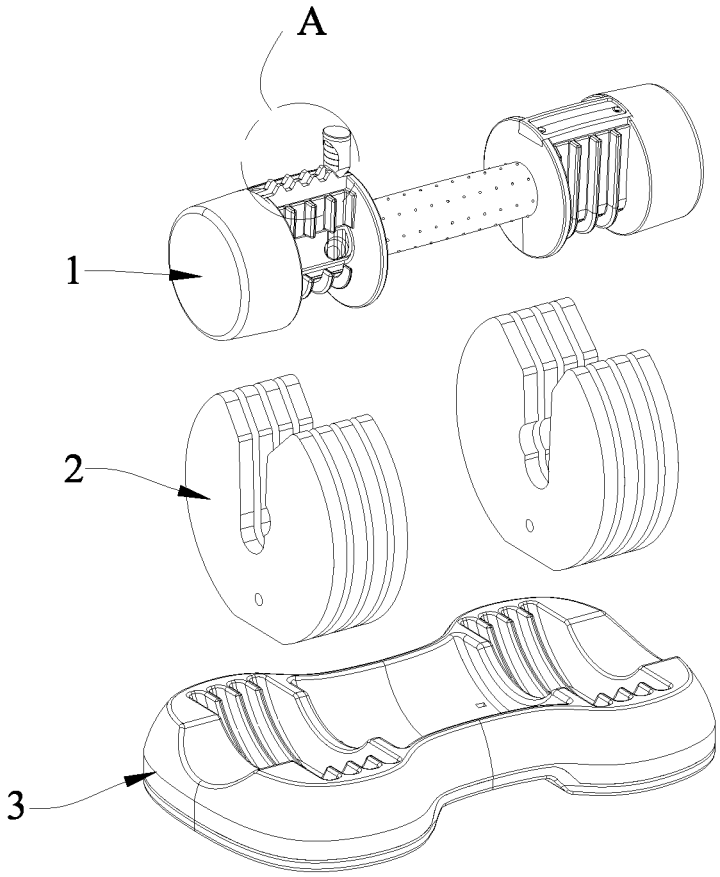
FIG. 2 is a structural schematic diagram of an adjustable dumbbell without dumbbell plates hooked according to an embodiment of the application.
Figure 3:
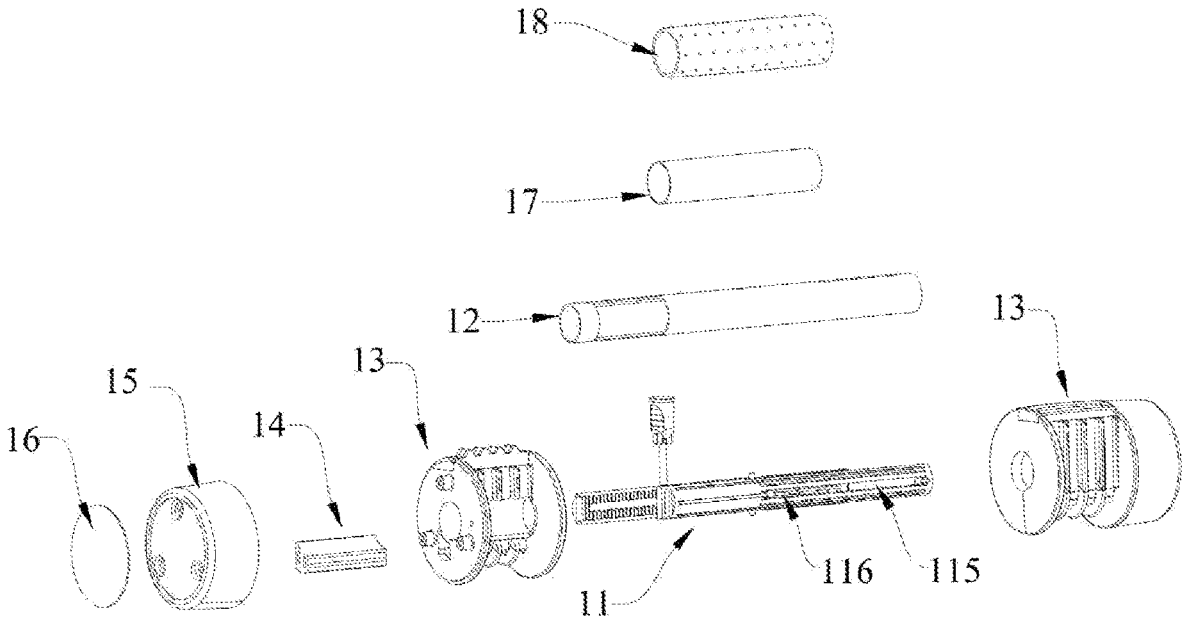
FIG. 3 is a structural exploded schematic diagram of a dumbbell bar assembly of an adjustable dumbbell according to an embodiment of the application.
Figure 4:
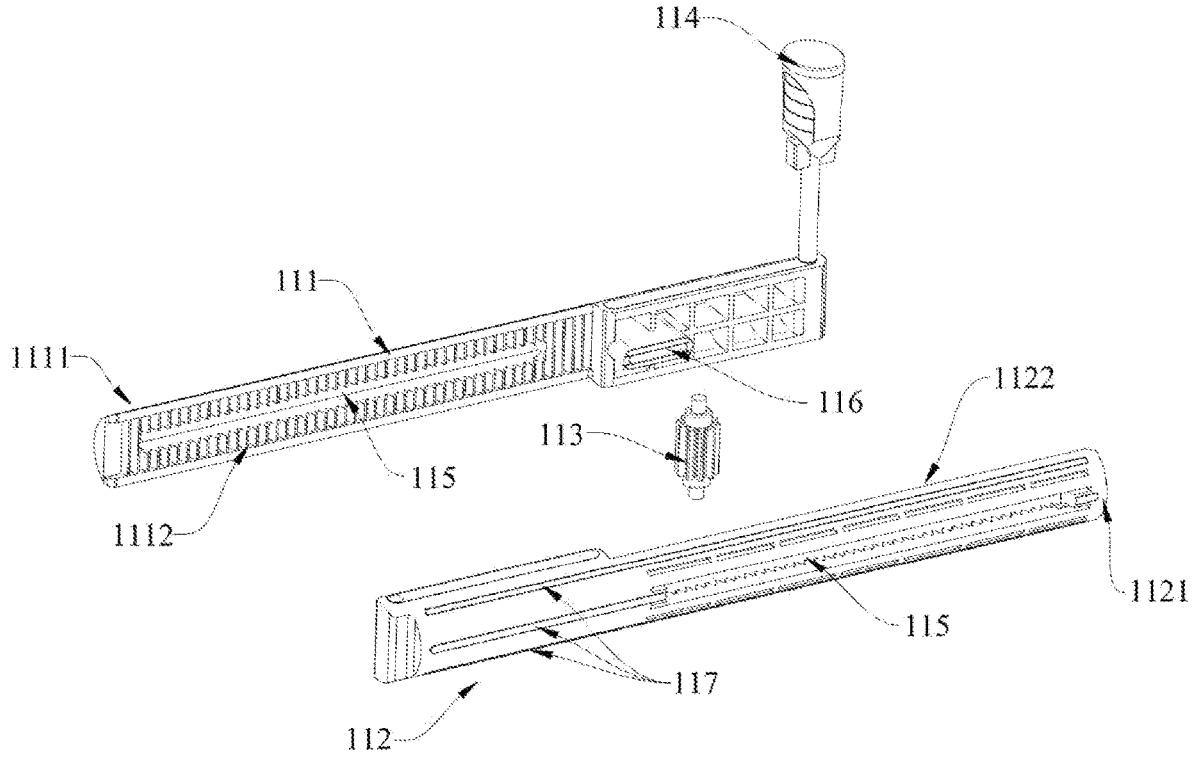
FIG. 4 is a schematic diagram of two bearing bars of a bearing bar set of an adjustable dumbbell in an unengaged state according to an embodiment of the application.
Figure 5:
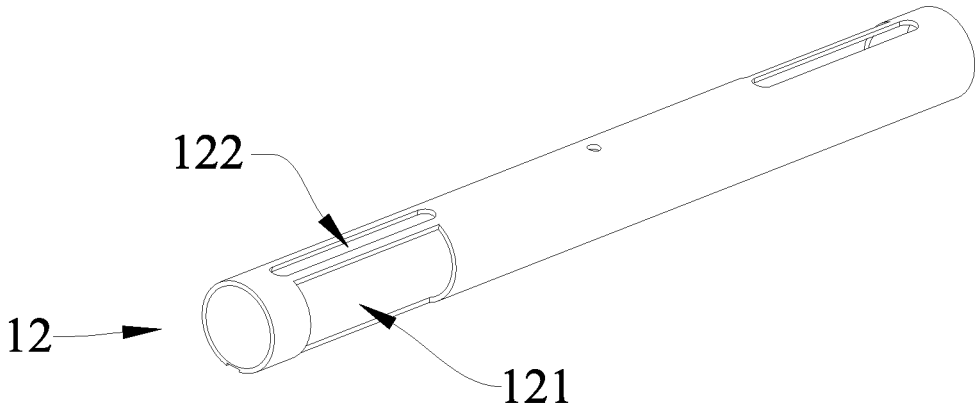
FIG. 5 is a structural schematic diagram of a casing of an adjustable dumbbell according to an embodiment of the application.
Figure 6:
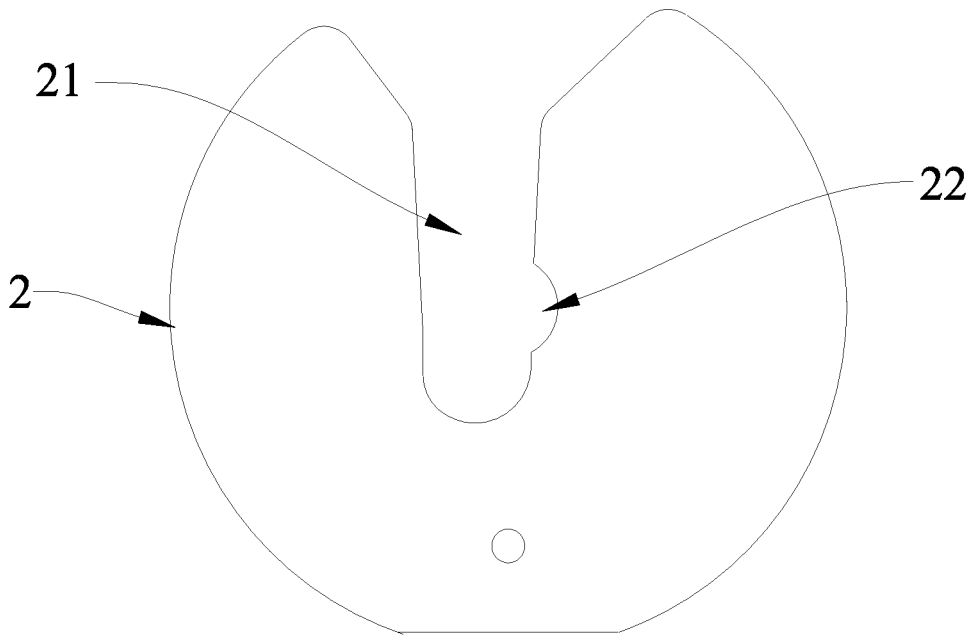
FIG. 6 is a main view of a dumbbell plate of an adjustable dumbbell according to an embodiment of the application.
Figure 7:
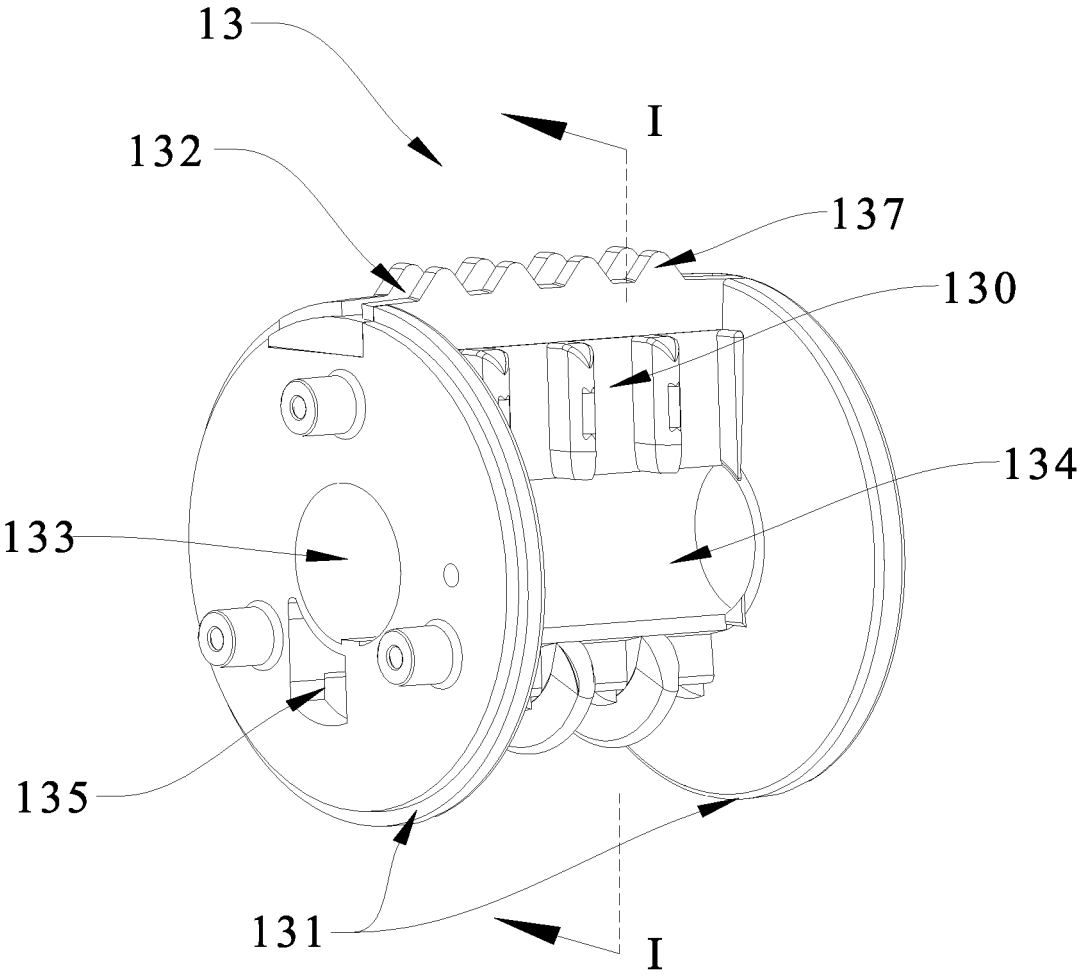
FIG. 7 is a structural schematic diagram of an inserting plate assembly of an adjustable dumbbell according to an embodiment of the application.
Figure 8:
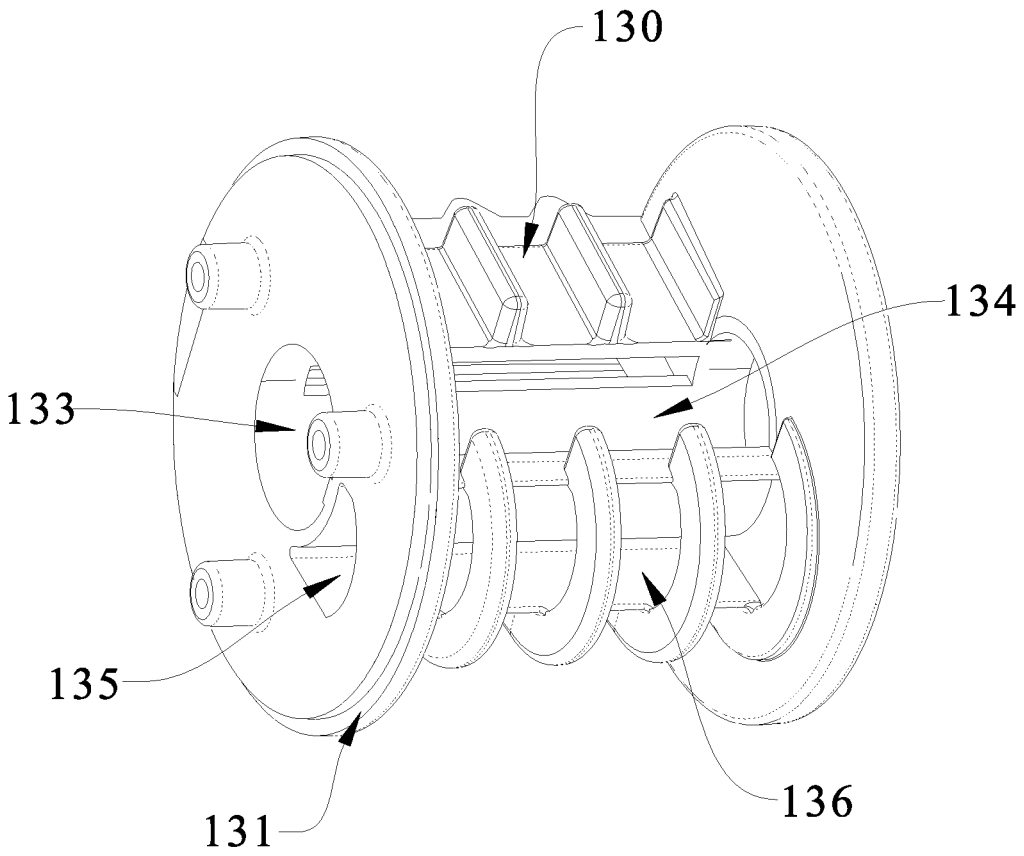
FIG. 8 is a schematic diagram showing a bottom structure of an inserting plate assembly of an adjustable dumbbell according to an embodiment of the application.
Figure 9:
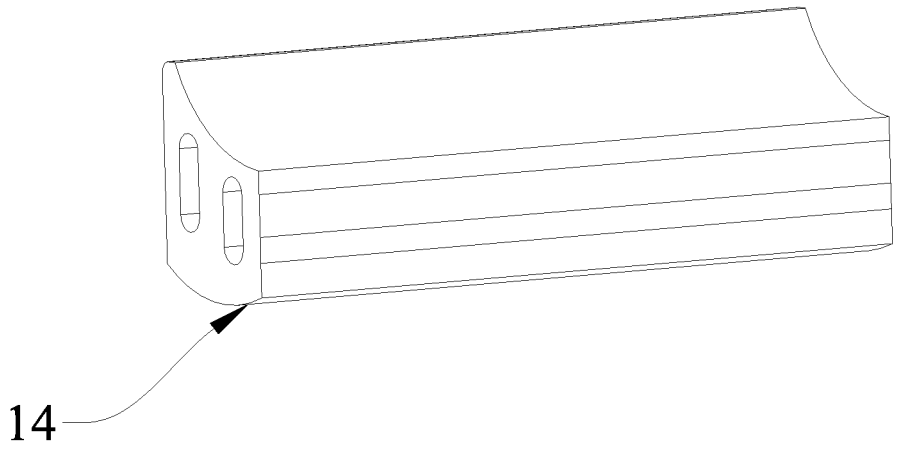
FIG. 9 is a structural schematic diagram of a damping block of an adjustable dumbbell according to an embodiment of the application.

Brief descriptions of the drawings: 1—dumbbell bar assembly; 11—bearing bar set; 111—left rack bearing bar; 1111—left bearing part; 1112—left rack part; 112—right rack bearing bar; 1121—right bearing part; 1122—right rack part; 113—spur gear shaft; 114—adjusting handle; 1141—adjusting handle housing; 1142—bolt; 1143—cover cap; 1144—spring; 1145—positioning part; 115—sliding groove; 116—sliding block; 117—protruding strips; 12—casing; 121—communicating port; 122—guide slot; 13—inserting plate assembly; 130—hollow inserting plate; 131—baffle; 132—second open slot; 133—center through hole; 134—third open slot; 135—damping block mounting hole; 136—first open slot; 137—positioning rack; 14—damping block; 15—grip counterweight; 16—end cap; 17—hollow tube; 18—grip tube; 2—dumbbell plate; 21—insertion port; 22—hooking groove; 3—base.

DETAILED DESCRIPTION OF THE EMBODIMENTS

The application will be described in detail below regarding the accompanying drawings and examples. Each example is provided by way of an explanation of the application, not a limitation of the application. In fact, those skilled in the art will recognize that modifications and variations can be made in the application without departing from the scope or spirit of the application. For example, features illustrated or described as part of one embodiment can be used on another embodiment to yield a still further embodiment. Therefore, it is intended that the application includes such modifications and variations as come within the scope of the appended claims and their equivalents.

In the description of the application, the orientations or positional relationships indicated by the terms "longitudinal", "transverse", "upper", "lower", "front", "rear", "left", "right", "vertical", "horizontal", "top", "bottom", etc. are based on the orientations or positional relationships shown in the drawings and are only for the convenience of describing the application, rather than requiring that the application must be constructed and operated in a specific orientation, so they cannot be interpreted as limitations to the application. The terms "linked", "connected" and "arranged" used in the application should be understood in a broad sense, for example, it can be a fixed connection or a detachable connection, it can be directly connected or indirectly connected through an intermediate component, and it also can be a wired connection, a radio connection, or a wireless communication signal connection. Those of ordinary skill in the art can understand the specific meanings of the above terms in the application according to specific situations.

One or more examples of the application are illustrated in the accompanying drawings. The detailed description uses numerical and letter designations to refer to features in the drawings. Like or analogous numerals in the drawings and description have been used to refer to like or analogous parts of the application. As used herein, the terms "first", "second", and "third" are used interchangeably to distinguish one element from another, and are not intended to indicate the location or importance of individual elements.

As shown in FIGS. 1-14, according to the embodiments of the application, an adjustable dumbbell is provided, which includes a dumbbell bar assembly 1, eight dumbbell plates 2 used to be hooked to two sides of the dumbbell bar assembly 1, and a base 3 used for placing the dumbbell plates 2.

The dumbbell bar assembly 1 includes a bearing bar set 11. The bearing bar set 11 includes a left rack bearing bar 111 and a right rack bearing bar 112 which are identical in shape and size, and a spur gear shaft 113 which is arranged between the left rack bearing bar 111 and the right rack bearing bar 112 and is meshed with the left rack bearing bar 111 and the right rack bearing bar 112 for transmission. A left bearing part 1111 and a left rack part 1112 are respectively arranged at two sides of the left rack bearing bar 111. A right bearing part 1121 and a right rack part 1122 are respectively arranged at two sides of the right rack bearing bar 112. The spur gear shaft 113 is meshed with the left rack part 1112 and the right rack part 1122 for transmission separately. When the left rack bearing bar 111 slides leftwards or rightwards, the right rack bearing bar 112 synchronously slides leftwards or rightwards relative to the left rack bearing bar 111. An adjusting handle 114 is fixedly installed at one end of an upper surface of the left rack bearing bar 111 and used for manually operating and moving the left rack bearing bar 111. the left rack part 1112 of the left rack bearing bar 111 and the right rack part 1122 of the right rack bearing bar 112 are respectively provided with sliding grooves 115. The right rack bearing bar 112 is provided with a sliding block 116 corresponding to the sliding groove 115 of the left rack bearing bar 111. Similarly, the left rack bearing bar 111 is provided with a sliding block 116 corresponding to the sliding groove 115 of the right rack bearing bar 112. The corresponding sliding blocks 116 slide in the sliding grooves 115 to ensure that the left rack bearing bar 111 and the right rack bearing bar 112 are adjusted smoothly and movement between the bearing bars is reduced.

The dumbbell bar assembly 1 further includes a casing 12. The left rack bearing bar 111, the right rack bearing bar 112 and the spur gear shaft 113 are meshed and installed inside the casing 12, and a tube wall of the casing 12 is respectively provided with communicating ports 121 corresponding to the left bearing part 1111 of the left rack bearing bar 111 and the right bearing part 1121 of the right rack bearing bar 112 so that the left bearing part 1111 and the right bearing part 1121 are hooked to the dumbbell plates 2 through the communicating ports 121. The tube wall of the casing 12 is provided with a guide slot 122 corresponding to the position of the adjusting handle 114 on the left rack bearing bar 111 so that the adjusting handle 114 can slide in the guide slot 122 along the axial direction of the casing 12.

To reduce movement of the bearing bar set 11 in the casing 12, a surface of the left bearing part 1111 of the left rack bearing bar 111 and a surface of the right bearing part 1121 of the right rack bearing bar 112 are respectively provided with three protruding strips 117. The protruding strips 117 abut against an inner wall of the casing 12. On the premise of not impeding sliding of the bearing bar set 11 in the casing 12, movement of the bearing bar set 11 inside the casing 12 is reduced.

Open insertion ports 21 are formed in the middles of the dumbbell plates 2. A hooking groove 22 is formed at one side of each of the insertion ports 21. The bearing bar set 11 is inserted through the insertion ports 21. When the left bearing part 1111 or the right bearing part 1121 is located in the hooking grooves 22, the bearing bar set 11 can hook the corresponding dumbbell plates 2.

Two ends of a combined part of the bearing bar set 11 and the casing 12 after installation are respectively and fixedly provided with one inserting plate assembly 13 used for being inserted into the dumbbell plates 2. Each of the inserting plate assemblies 13 includes a hollow inserting plate 130, and baffles 131 are respectively arranged at two ends of the hollow inserting plate 130. When the hollow inserting plate 130 is inserted through the insertion ports 21 of the dumbbell plates 2, the multiple dumbbell plates 2 are placed between the two baffles 131 on the hollow inserting plate 130. A top of the hollow inserting plate 130 is provided with a second open slot 132 communicating with internal parts thereof. A center through hole 133 running through the hollow inserting plate 130 and the baffles 131 at the two ends thereof is formed in a middle position of the hollow inserting plate 130. The center through hole 133 runs through the hollow inserting plate 130 to form a third open slot 134 in a plate surface of one side of the hollow inserting plate 130. The second open slot 132 communicates with the center through hole 133. The two inserting plate assembles 13 are sleeved at the two ends of the combined part of the bearing bar set 11 and the casing 12 after installation through the center through holes 133. Opening directions of the third open slots 134 of the two inserting plate assemblies 13 are opposite at installation time so that the third open slots 134 correspond with the communicating ports 121 of the casing 12, and the bearing parts of the bearing bar set 11 penetrate through the corresponding third open slots 134 to hook the dumbbell plates 2. Meanwhile, the guide slot 122 of the casing 12 corresponds to the second open slot 132, so that the adjusting handle 114 adjusts the bearing bar set 11 at an outer side of the corresponding inserting plate assembly 13 through the second open slot 132. Damping block mounting holes 135 running through the hollow inserting plates 130 and the baffles 131 at the two ends thereof are further formed in positions, located below the center through holes 133, of the inserting plate assemblies 13. The damping block mounting holes 135 form first open slots 136 at bottom sides of the hollow inserting plates 130. Damping blocks 14 are installed in the damping block mounting holes 135. The damping blocks 14 are made of a material with cushioning and vibration-damping effects. When the inserting plate assemblies 13 are inserted into the insertion ports 21 of the dumbbell plates 2, bottoms of the damping blocks 14 abut against bottoms of the insertion ports 21 through the first open slots 136. When the dumbbell plates 2 and the inserting plate assemblies 13 do relative movement under the action of inertia in the using process, the damping blocks 14 can offset relative displacement of the dumbbell plates 2 and the inserting plate assemblies 13 through clastic deformation, thereby reducing movement of the dumbbell plates 2 and resonance between the dumbbell plates 2 and the inserting plate assemblies 13 in the using process, and improving user experience.

Figure 10:
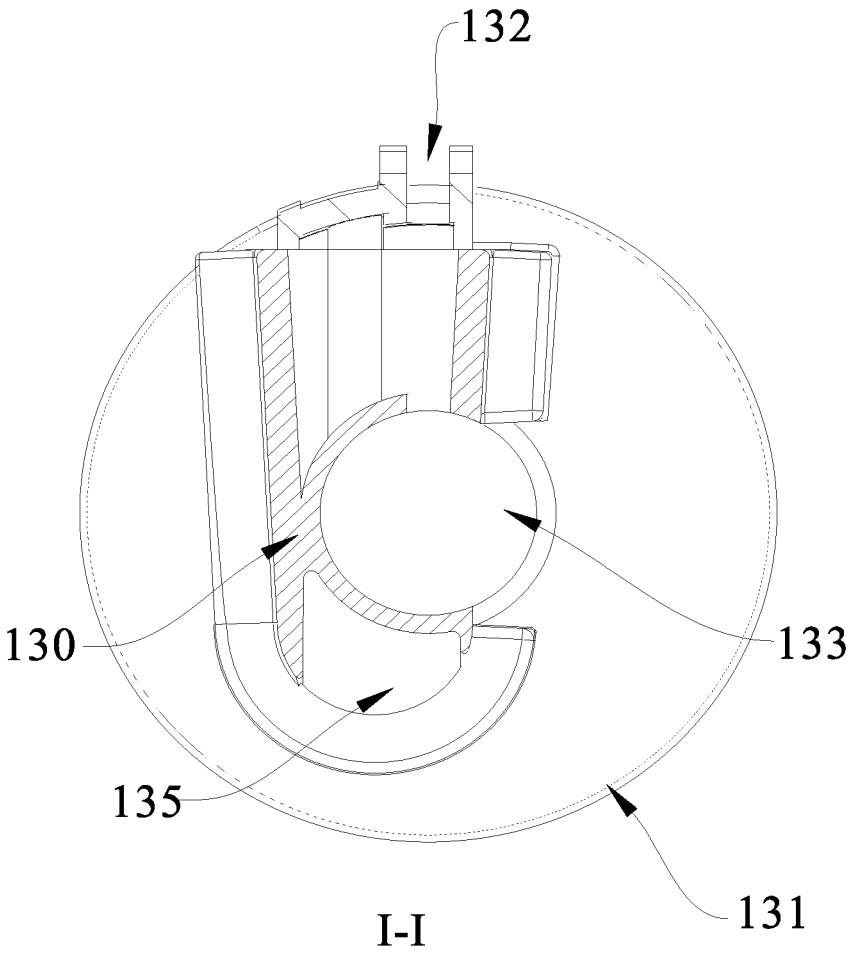
FIG. 10 is a schematic diagram of a cross-sectional structure of the inserting plate assembly at I-I of FIG. 7.
Figure 11:
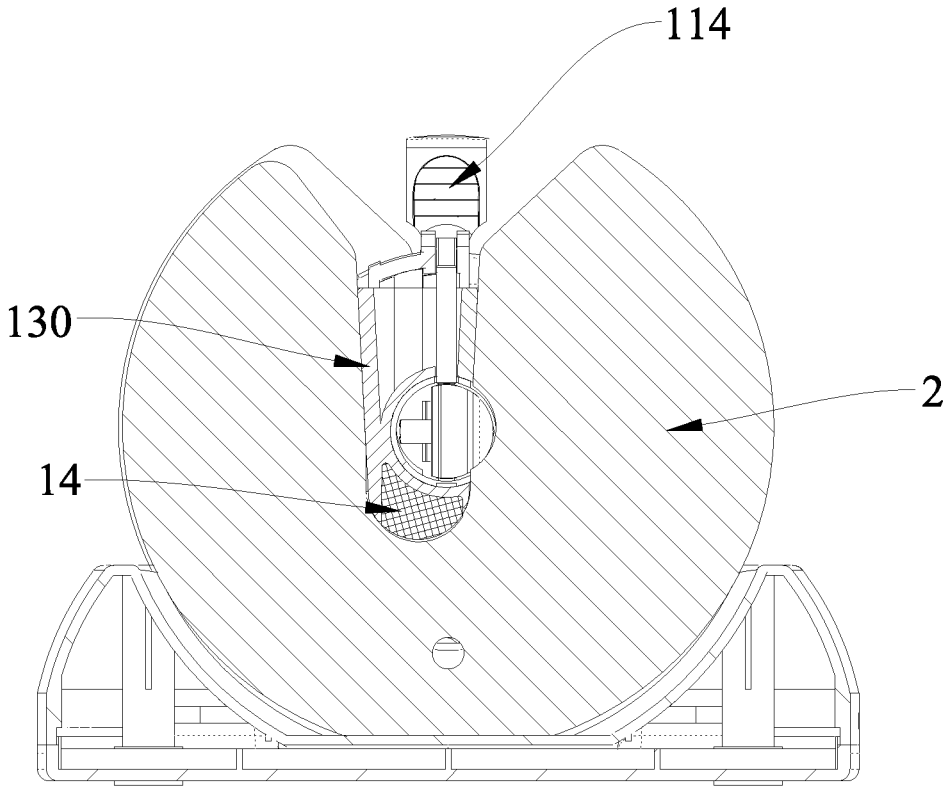
FIG. 11 is a schematic diagram of a cross-sectional structure of a V-shaped hollow inserting plate of an inserting plate assembly of an adjustable dumbbell inserted into V-shaped dumbbell plates according to an embodiment of the application.
Figure 12:
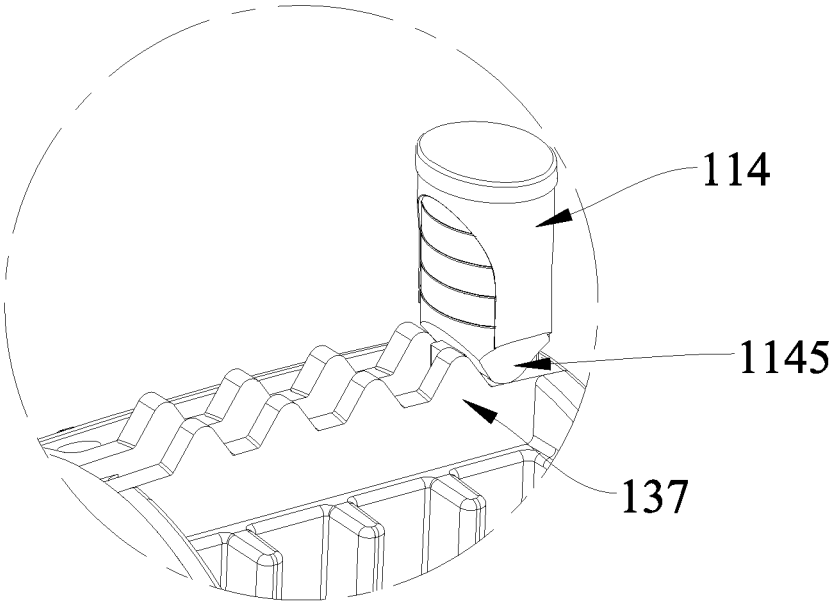
FIG. 12 is an amplified structural schematic diagram of a portion marked by a circle at A of FIG. 2.

To further reduce movement between the inserting plate assemblies 13 and the dumbbell plates 2, as shown in FIGS. 10-11, the insertion ports 21 of the dumbbell plates 2 are arranged in a V shape, and correspondingly, cross-sections of the hollow inserting plates 130 are arranged in a V shape matched with the insertion ports 21 in shape and size so that the hollow inserting plates 130 are more closely matched with inner walls of the insertion ports 21 of the dumbbell plates 2 when the hollow inserting plates 130 are inserted into the insertion ports 21, thereby reducing gaps between the hollow inserting plates 130 and the insertion ports 21, and reducing phenomena of left-right movement of the dumbbell plates 2 on the inserting plate assemblies 13.

To avoid falling when the user uses a dumbbell to exercise, positioning racks 137 are arranged at the position of the second open slots 132 on the inserting plate assemblies 13 and used to lock the corresponding sliding position of the adjusting handle 114. Each positioning rack 137 is provided with four teeth corresponding to four adjusting positions. Every time the adjusting handle 114 moves by one adjusting position, correspondingly, one hooked dumbbell plate 2 is increased or decreased at left and right ends of the bearing bar set 11 respectively.

Figure 13:
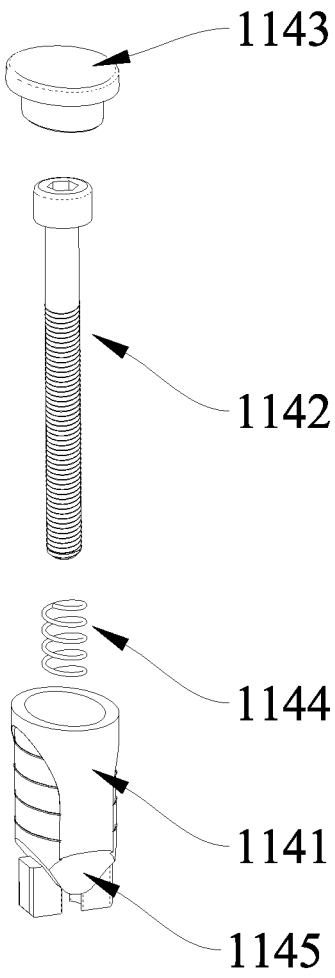
FIG. 13 is a structural exploded schematic diagram of an adjusting handle of an adjustable dumbbell according to an embodiment of the application.
Figure 14:
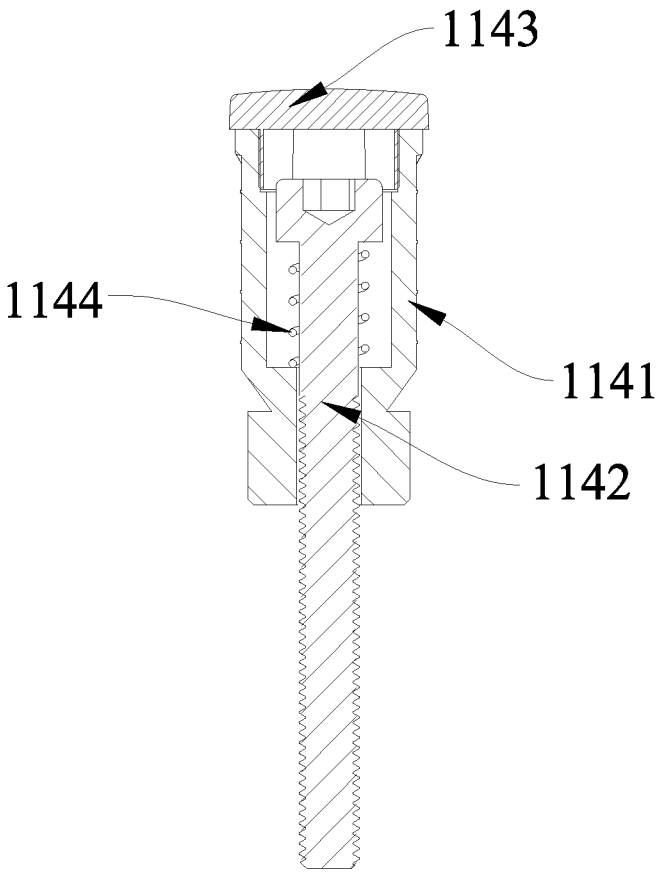
FIG. 14 is a schematic diagram of a cross-sectional structure of an adjusting handle of an adjustable dumbbell according to an embodiment of the application.

Shown in FIG. 13-14, the adjusting handle 114 includes a hollow adjusting handle housing 1141 and a bolt 1142. The bolt 1142 is installed inside the adjusting handle housing 1141. A screw of the bolt 1142 partially penetrates out of a bottom of the adjusting handle housing 1141 to be in threaded connection with the left rack bearing bar 111. A cover cap 1143 is arranged at an upper end of the adjusting handle housing 1141. When the cover cap 1143 is covered at an upper end of the adjusting handle housing 1141, a nut part of the bolt 1142 is limited inside the adjusting handle housing 1141, further, a spring 1144 is sleeved on the bolt 1142, one end of the spring 1144 abuts against a bottom end of the nut part of the bolt 1142, and the other end of the spring 1144 abuts against a bottom side of an inner wall of the adjusting handle housing 1141. When the adjusting handle housing 1141 is lifted, the spring 1144 is compressed. When the adjusting handle housing 1141 is loosened, the adjusting handle housing 1141 moves downwards under the action of restoring force of the spring 1144. Further, tops of the four teeth of each positioning rack 137 are provided with smooth round corners. A bottom end of an outer side of the adjusting handle housing 1141 is provided with a positioning part 1145 matched with the positioning racks 137. When the positioning part 1145 is located at tooth roots of the positioning teeth, the adjusting handle is locked. Further, a bottom end of the positioning part 1145 has a round corner so that the adjusting handle 114 can slide between adjusting positions on the positioning racks 137. When the adjusting handle 114 is lifted up and loosened, the adjusting handle 114 automatically falls into the corresponding adjusting position under the action of restoring force of the spring 1144, thereby preventing the dumbbell plates 2 from falling due to the fact that the adjusting handle 114 gets stuck between two adjusting positions.

The dumbbell bar assembly 1 further includes a hollow tube 17. The hollow tube 17 is sleeved outside the casing 12. A rubber grip tube 18 is sleeved on an outer side of the hollow tube 17. The hollow tube 17 is arranged between the grip tube 18 and the casing 12 to facilitate force control at the grip tube 18.

Further, grip counterweights 15 are fixedly connected to ends of the two inserting plate assemblies 13 respectively to increase the weight of the dumbbell bar assembly 1 without the dumbbell plates 2 hooked and increase forms of exercise without the dumbbell plates hooked. End caps 16 are fixedly connected to ends of the grip counterweights 15 and used for concealing cap screws at the ends of the grip counterweights 15 so that the dumbbell overall looks more attractive.

The adjustable dumbbell further includes a base 3. The base 3 is provided with a plurality of dumbbell plate grooves for placing the multiple dumbbell plates 2 to facilitate insertion of the dumbbell bar assembly 1 and weight adjustment.

From the above description, it can be seen that the foregoing embodiments of the application achieve the following technical effects:

1. The two rack bearing bars of the bearing bar set 11 are respectively provided with the sliding grooves 115 and the sliding blocks 116. When the sliding block 116 on one rack bearing bar slides in the sliding groove 115 of the other rack bearing bar, and it can be ensured that the two rack bearing bars are adjusted smoothly and movement of the bearing bars is reduced.
2. An outer surface of the bearing bar set 11 is provided with the plurality of protruding strips 117 used to abut against the inner wall of the casing 12, and on the premise of not impeding sliding of the bearing bar set 11 in the casing 12, movement of the bearing bar set 11 inside the casing 12 is reduced.
3. The insertion ports 21 of the dumbbell plates 2 are designed into the V shape, and correspondingly, the cross-sections of the hollow inserting plates 130 are arranged in the V shape matched with the insertion ports 21 in shape and size so that the hollow inserting plates 130 are more closely matched with the inner walls of the insertion ports 21 when the hollow inserting plates 130 are inserted into the insertion ports 21, thereby reducing the gaps between the hollow inserting plates 130 and the insertion ports 21, and reducing the phenomena of left-right movement of the dumbbell plates 2 on the inserting plate assemblies 13.
4. The inserting plate assemblies 13 are provided with the damping block mounting holes 135. The damping block mounting holes 135 form the first open slots 136 at the bottom sides of the hollow inserting plates 130. The damping blocks 14 are installed in the damping block mounting holes 135. The damping blocks 14 are made of the material with cushioning and vibration damping effects. When the inserting plate assemblies 13 are inserted into the insertion ports 21 of the dumbbell plates 2, the bottoms of the damping blocks 14 abut against the bottoms of the insertion ports 21 through the first open slots 136. The damping blocks 14 can offset relative displacement between the dumbbell plates 2 and the inserting plate assemblies 13 through elastic deformation, thereby reducing movement of the dumbbell plates 2 and resonance between the dumbbell plates 2 and the inserting plate assemblies 13 in the using process, and improving user experience.
5. The positioning racks 137 are arranged at the second open slots 132 of the inserting plate assemblies 13. The tops of the teeth of the positioning racks 137 are all provided with the round corners. Correspondingly, the bottom end of the outer side of the adjusting handle housing 1141 is arranged to be the round corner matched with the positioning racks 137 to facilitate the adjusting handle 114 sliding between the adjusting positions on the positioning racks 137. In addition, the spring 1144 is sleeved on the bolt 1142 inside the adjusting handle 114 so that the adjusting handle 114 can automatically fall into the corresponding adjusting position under the action of restoring force of the spring 1144 when lifted, thereby preventing the dumbbell plates 2 from falling due to the fact that the adjusting handle 114 gets stuck between the two adjusting positions.

Compared with the prior art, when the adjustable dumbbell of the application is used, movement inside the dumbbell bar assembly and movement at joints between the dumbbell bar assembly and the dumbbell plates are small, and the fear of the user in the using process is reduced, so the user can concentrate on the training process.

The above descriptions are only preferred embodiments of the application and are not intended to limit the application. For those skilled in the art, the application may have various modifications and changes. Any modifications, equivalent replacements, improvements, etc. made within the spirit and principles of the application shall be included within the protection scope of the application.

What is claimed is:

1. An adjustable dumbbell, comprising a dumbbell bar assembly and a plurality of dumbbell plates hooked to two sides of the dumbbell bar assembly, wherein inserting plate assemblies for being inserted into insertion ports of the dumbbell plates and limiting the dumbbell plates to rotate are disposed at two ends of the dumbbell bar assembly, the inserting plate assemblies are provided with damping block mounting holes, the damping block mounting holes form first open slots at bottoms of the inserting plate assemblies, damping blocks are installed in the damping block mounting holes, and bottoms of the damping blocks abut against bottoms of the insertion ports of the dumbbell plates through the first open slots.

2. The adjustable dumbbell according to claim 1, wherein the dumbbell bar assembly comprises a bearing bar set, a casing is sleeved outside the bearing bar set, an outer wall of the bearing bar set is provided with protruding strips, and the protruding strips abut against an inner wall of the casing.

3. The adjustable dumbbell according to claim 2, wherein the bearing bar set comprises a left rack bearing bar and a right rack bearing bar which are identical in shape and size, and a spur gear shaft, the spur gear shaft is hinged to an interior of the casing, the left rack bearing bar and the right rack bearing bar are meshed with the spur gear shaft for transmission in the casing, a left rack part and a right rack part are respectively arranged on opposite sides of the left rack bearing bar and the right rack bearing bar, and a left bearing part and a right bearing part are respectively arranged on back sides of the left rack bearing bar and the right rack bearing bar; and a plurality of protruding strips are arranged and respectively located on surfaces of the left bearing part and the right bearing part.

4. The adjustable dumbbell according to claim 3, wherein the left rack part and the right rack part are respectively provided with sliding grooves, the right rack bearing bar is provided with a sliding block corresponding to the sliding groove of the left rack bearing bar the left rack bearing bar is provided with a sliding block corresponding to the sliding groove of the right rack bearing bar, and the corresponding sliding blocks respectively slide in the corresponding sliding grooves.

5. The adjustable dumbbell according to claim 1, wherein the inserting plate assembly comprise hollow inserting plates, the hollow inserting plates are configured to be inserted into the insertion ports of the dumbbell plates, the insertion ports are arranged in a V shape, and correspondingly, cross-sections of the hollow inserting plates are arranged in a V shape matched with the insertion ports in shape and size so that the hollow inserting plates are closely matched with the dumbbell plates when the hollow inserting plates are inserted into the insertion ports.

6. The adjustable dumbbell according to claim 2, wherein tops of the inserting plate assemblies are provided with second open slots communicating with internal parts thereof, the bearing bar set is provided with an adjusting handle, and the adjusting handle penetrates through the second open slots to be fixedly connected with the bearing bar set; and positioning racks are arranged at the second open slots, each of the positioning racks is provided with a plurality of positioning teeth, correspondingly, a bottom end of the adjusting handle is provided with a positioning part matched with the positioning racks, and when the positioning part is located at tooth roots of the positioning teeth, the adjusting handle is locked.

7. The adjustable dumbbell according to claim 6, wherein the adjusting handle comprises a hollow adjusting handle housing and a bolt, a nut part of the bolt is installed inside the adjusting handle, a screw of the bolt partially penetrates out of a bottom of the adjusting handle housing to be in threaded connection with the bearing bar set, a spring is sleeved on the bolt, one end of the spring abuts against a bottom end of the nut part of the bolt, and an other end of the spring abuts against a bottom side of an inner wall of the adjusting handle housing.

8. The adjustable dumbbell according to claim 3, wherein the left rack bearing bar, the right rack bearing bar and the spur gear shaft are meshed and installed inside the casing, and a tube wall of the casing is respectively provided with communicating ports corresponding to the left bearing part of the left rack bearing bar and the right bearing part of the right rack bearing bar so that the left bearing part and the right bearing part are hooked to the dumbbell plates through the communicating ports.

9. The adjustable dumbbell according to claim 8, wherein the dumbbell bar assembly further comprises a hollow tube, the hollow tube is sleeved outside the casing, and a rubber grip tube is sleeved on an outer side of the hollow tube.

10. The adjustable dumbbell according to claim 1, wherein grip counterweights are fixedly connected to ends of the two inserting plate assemblies respectively.

* * * * *